US007590369B2

(12) United States Patent
Wazana et al.

(10) Patent No.: US 7,590,369 B2
(45) Date of Patent: Sep. 15, 2009

(54) SYSTEM AND METHOD FOR SEPARATING AND REPAIRING A LASER TONER CARTRIDGE

(75) Inventors: Yoel Wazana, Chatsworth, CA (US); Joda Paulus, Chatsworth, CA (US); Jack Dutton, Palmdale, CA (US)

(73) Assignee: Wazana Brothers International, Inc., Van Nuys, CA (US)

( * ) Notice: Subject to any disclaimer, the term of this patent is extended or adjusted under 35 U.S.C. 154(b) by 247 days.

(21) Appl. No.: 11/799,350

(22) Filed: May 1, 2007

(65) Prior Publication Data

US 2008/0273894 A1 Nov. 6, 2008

(51) Int. Cl.
*G03G 15/00* (2006.01)

(52) U.S. Cl. ..... 399/109

(58) Field of Classification Search ..... 399/107, 399/109, 111, 113; 83/870; 156/73.1, 73.5, 156/94

See application file for complete search history.

(56) References Cited

U.S. PATENT DOCUMENTS 5,657,678 A * 8/1997 Cohen ..... 83/870
5,676,794 A 10/1997 Baley
6,289,188 B1 9/2001 Litman et al.
6,596,110 B1 * 7/2003 Chitouras ..... 156/94
6,684,039 B1 1/2004 Wazana et al.
6,801,734 B1 10/2004 Jones et al.
6,987,937 B2 1/2006 Wazana et al.
2003/0170045 A1 9/2003 Lewis et al.
2005/0151832 A1 7/2005 Martin

* cited by examiner

*Primary Examiner*—Hoan H Tran
(74) *Attorney, Agent, or Firm*—Lewis, Brisbois, Bisgaard & Smith LLP

(57) ABSTRACT

Systems and methods for precision separation of the toner hopper section from the roller section of a spent plastic toner cartridge along the seam joining the two sections and without loss of significant amount of the plastic material that forms the cartridge, resulting in separated components that facilitate re-assembly to OEM specifications, by precisely positioning a cartridge in a jig, then splitting the cartridge by forcing pneumatically operated blades along the seam, the blades being configured to precisely split a specific cartridge design without significant loss of material.

10 Claims, 14 Drawing Sheets

SYSTEM AND METHOD FOR SEPARATING AND REPAIRING A LASER TONER CARTRIDGE

TECHNICAL FIELD

The presently described systems and methods relate generally to improvements in the field of laser toner cartridge repair and/or remanufacturing. Specifically, a system and method for precision separation of the hopper section from the roller section of a cartridge, and without loss of significant amounts of the plastic material that forms the original cartridge.

BACKGROUND ART

Conventional laser printer toner cartridges are manufactured to a relatively high degree of precision necessary for proper operation and good printed image quality, with most tolerances measured in the thousandths of an inch. Of importance to the proper operation of a laser toner cartridge is the maintenance of alignment and orientation of its various components. Original equipment manufacturers (OEM) achieve the rigidity necessary to maintain the alignment and orientation of components, in substantial part, by ultrasonically welding the sections of the toner cartridge together. The process of repairing a spent toner cartridge typically requires that the cartridge be disassembled. Specifically, the toner hopper section of the cartridge, which holds the toner, is separated from the magnetic or developer roller section of the cartridge. When the separated hopper and roller sections are joined back together, precise alignment and orientation of performance critical components are necessary, particularly among the magnetic or developer roller section, the hopper port seals, and the joining of the magnetic or developer roller housing to the hopper tank section.

Conventional cutting of the toner cartridge is accomplished with mechanical saws or grinders to separate the magnetic or developer roller section from the toner hopper section. Conventional toner cartridge separation methods and devices are described in, for example, U.S. Pat. Nos. 5,223,068; 5,407,518; 5,525,183; and, 5,676,794. Typically, conventional techniques use a circular saw blade having a thickness in the range of about 0.020 inch to about $1/16^{th}$ of an inch to cut or separate the developer roller section from the toner hopper section of the cartridge. These conventional cutting processes create a problem for re-assembly due to loss of a significant amount of the plastic material that formed the cartridge. This loss of material changes the cartridge and its components dimensionally from the OEM design specifications, and makes difficult the re-assembly of the cartridge with proper orientation and alignment. Separating the cartridge in this conventional way causes a loss of material that must be replaced when re-assembling the cartridge as it is rebuilt. Because of this loss of material, a shim is typically used. The shims are also referred to as spacers or stepped gaskets, and use of such components carries with it a significant risk that the repaired toner cartridge will not be returned to the OEM original design specifications.

A problem has existed in aligning the hopper tank seal, toner hopper and magnetic or developer roller housing when reassembling the three components with enough precision necessary to achieve a cartridge to match the OEM specifications. The conventional approach to this problem has been to manually align and fit the two sections together, with or without the aid of a positioning jig, then to manually secure the sections together with a number of metal clips. The sections maybe fastened together with clips, adhesive or glue in the reassembled cartridge. This technique, while generally effective, suffers many other deficiencies, or drawbacks. The most common drawback is that the dimensional height of the magnetic or developer roller housing has now been changed when measured to the OEM specifications for the toner hopper port to the magnetic or developer roller housing. Another drawback is that both metal clips and adhesives are consumables, which increases production costs and the cost of the final product. Another significant drawback is that manual reassembly is quite labor intensive, and is subject to human error and thus to a variation in quality. In the case of reassembly with adhesives or glue, there typically is a period of a few to several minutes for bonding to take place, during which alignment must be maintained and which often fuses or bonds the sections together, rendering subsequent additional remanufacturing or repair cycles difficult or impossible. An additional drawback from sawing is the use of metal clips to reassemble the cartridge in that the rigidity imparted by the saw cut is difficult to achieve, and over the working life of the cartridge the clips may loosen or become disengaged entirely. In such event, as a result of a loss of proper alignment of the toner hopper tank, seal and the magnetic or developer roller housing, excessive toner may accumulate on the magnetic or developer roller with the result of transferring too much toner to the photoconductive printing drum (OPC) and then to the printer paper, thereby degrading the printed page giving unsatisfactory image results and quality. Further, disengagement of one of the metal clips may permit toner to leak from the cartridge. In many printing devices, such as printers, facsimile, machines or copiers, the path of the paper through the printing device passes nearby to an edge of the toner cartridge where the metal clips have been installed. Paper jams can occur if a loose metal clip projects into the paper path. Printer failure can occur if a cartridge clip falls into the printer from a toner cartridge that has poorly cut pieces when assembled with clips.

OEM laser toner cartridges typically are sealed by ultrasonic welding. For the best quality, a remanufactured toner cartridge should be rebuilt to the same OEM specifications as designed. Disassembling the toner cartridge and reassembling it without losing its original design features, gives the best results. That technique has, until now, been unavailable for use in the remanufacture or reassembly of toner cartridge Industry. A primary impediment to the use of separating, or splitting the magnetic or developer roller from the toner hopper is lack of precision in the separation process, and loss of plastic material that formed the original cartridge. The less material lost during the cartridge component separation process, the better is the result of the reassembly process in joining the hopper section to the roller section of the cartridge in order to maintain the original integrity and dimensionality of the cartridge.

Hence, upon separation of the hopper and roller sections, if the cartridge is split at the weld joint without destroying anything else at that point, then the cartridge can be reassembled as close to the original equipment manufactures specification as possible.

SUMMARY DISCLOSURE

The present invention is directed to solving the above mentioned problems by providing a reassembled toner cartridge and method of manufacture in which the toner hopper tank and magnetic or developer roller housing are precisely separated or split at the ultrasonic weld joint, preferably along the energy director element for a clean split, without loss of the cartridge material and so as to facilitate the re-assembly of these components and the subsequent repair and/or remanufacture of the cartridge without destroying the integrity of the original design. Preferably the splitting is accomplished by holding the spent cartridge in a positioning jig in a precise, predetermined position, and then by driving or forcing cutting blades linearly along the joining surfaces of the hopper and roller sections with sufficient force to cleave or split these components apart and without the loss of material. By this splitting process the appearance and operational performance of repaired or remanufactured laser toner cartridges is improved. Also, by the present invention, due to its automatic and machine controlled features, the process is repeatable, human errors are minimized, and the speed and accuracy of the overall process is increased, all of which contributes to improved reliability and efficiency.

These and other embodiments, features, aspects, and advantages of the invention will become better understood with regard to the following description, appended claims and accompanying drawings.

BRIEF DESCRIPTION OF THE DRAWINGS

The foregoing aspects and features of the present invention, as well as its attendant advantages will become more readily appreciated by reference to the following detailed description, when taken in conjunction with the accompanying drawings depicted in FIGS. 1-34, wherein.

Reference symbols or names are used in the figures to indicate certain components, aspects or features shown therein. Reference symbols common to more than one figure indicate like components, aspects or features shown therein.

INDUSTRIAL APPLICABILITY AND MODES FOR CARRYING OUT THE SYSTEM AND METHODS

In accordance with embodiments of the present system and method conventional toner cartridges may be split along the OEM plastic ultrasonically welded seam in a way that facilitate repaired and/or reassembly of the cartridge.

Figure 1:
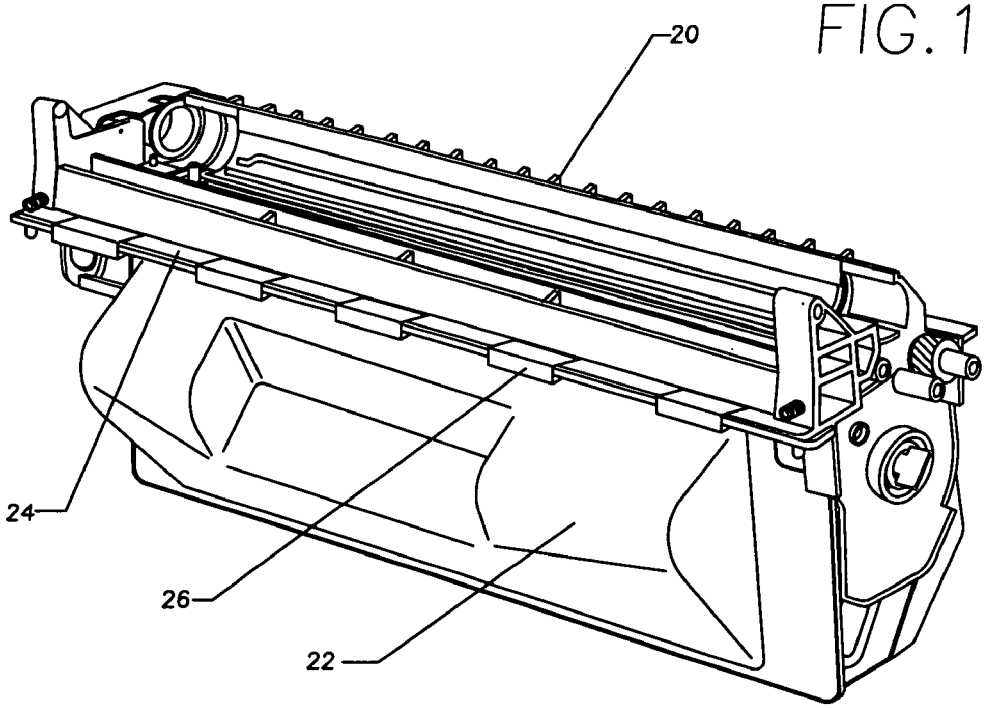
FIG. 1 is a perspective view of a toner cartridge that has been reassembled with clips.
Figure 2:
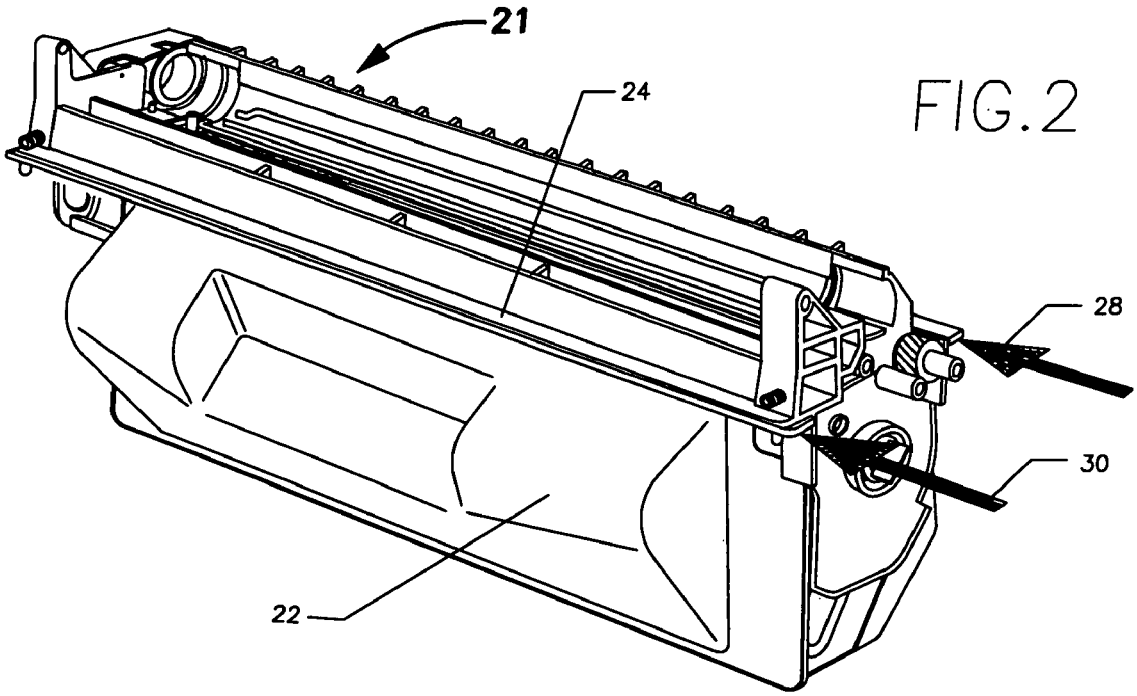
FIG. 2 is a perspective view of a toner cartridge that has been reassembled with ultrasonic welding.

Referring to FIG. 1 a repaired or remanufactured plastic laser toner cartridge 20 has toner hopper section 22 and a magnetic or developer roller section 24 held together with conventional clips 26. Separation of the toner section from the roller section could be accomplished by the present system and method. However, it is preferred that re-assembly of these sections is by ultrasonic welding, rather than through use of clips. FIG. 2 illustrates a repaired or remanufactured plastic laser toner cartridge 21 that has its toner hopper section 22 and roller section 24 held together through ultrasonic welding along the seam, or joining surfaces, as indicated by arrows 28 and 30. Methods of repairing and remanufacturing such cartridges by ultrasonic welding are described, for example in U.S. Pat. Nos. 6,684,039 and 6,577,830.

Figure 3:
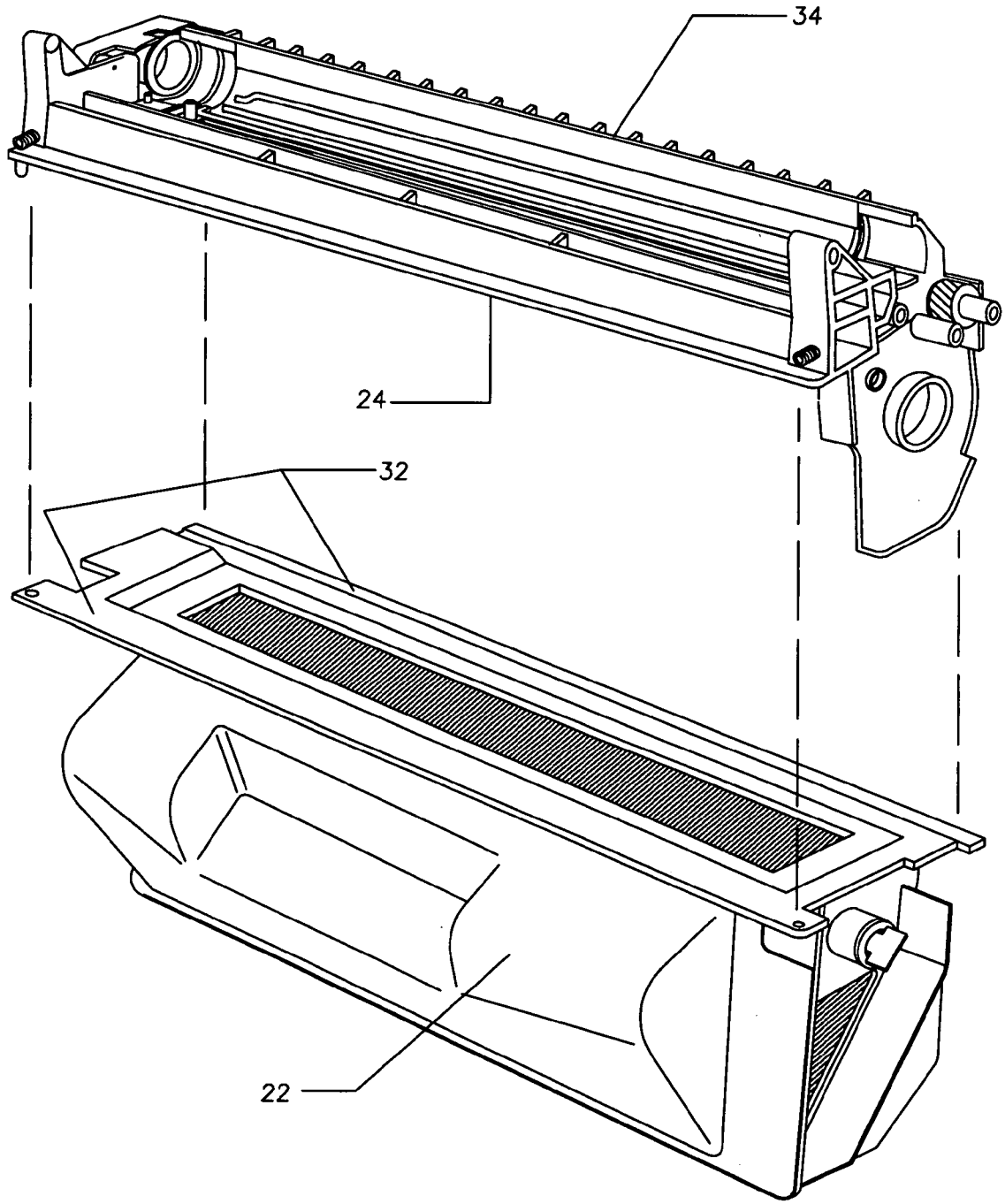
FIG. 3 is a split perspective view of a roller section and a hopper section of a toner cartridge.

FIG. 3 shows in perspective view a partially disassembled view of hopper section 22 and roller section 24 after the cartridge has been split in accordance with the present system and method. The split is along the seam, or weld of the original cartridge, shown by arrows 28 and 30 in FIG. 2. Essentially no loss of cartridge material results from the present invention, thus facilitating the re-assembly process, preferably through ultrasonic welding, to yield a repaired cartridge that meets OEM specifications. As will be appreciated by those skilled in this field, the cartridge includes other components such as a waste tank hopper, magnetic or developer roller and other sub-assemblies, none of which are shown in FIG. 3.

Figure 4:
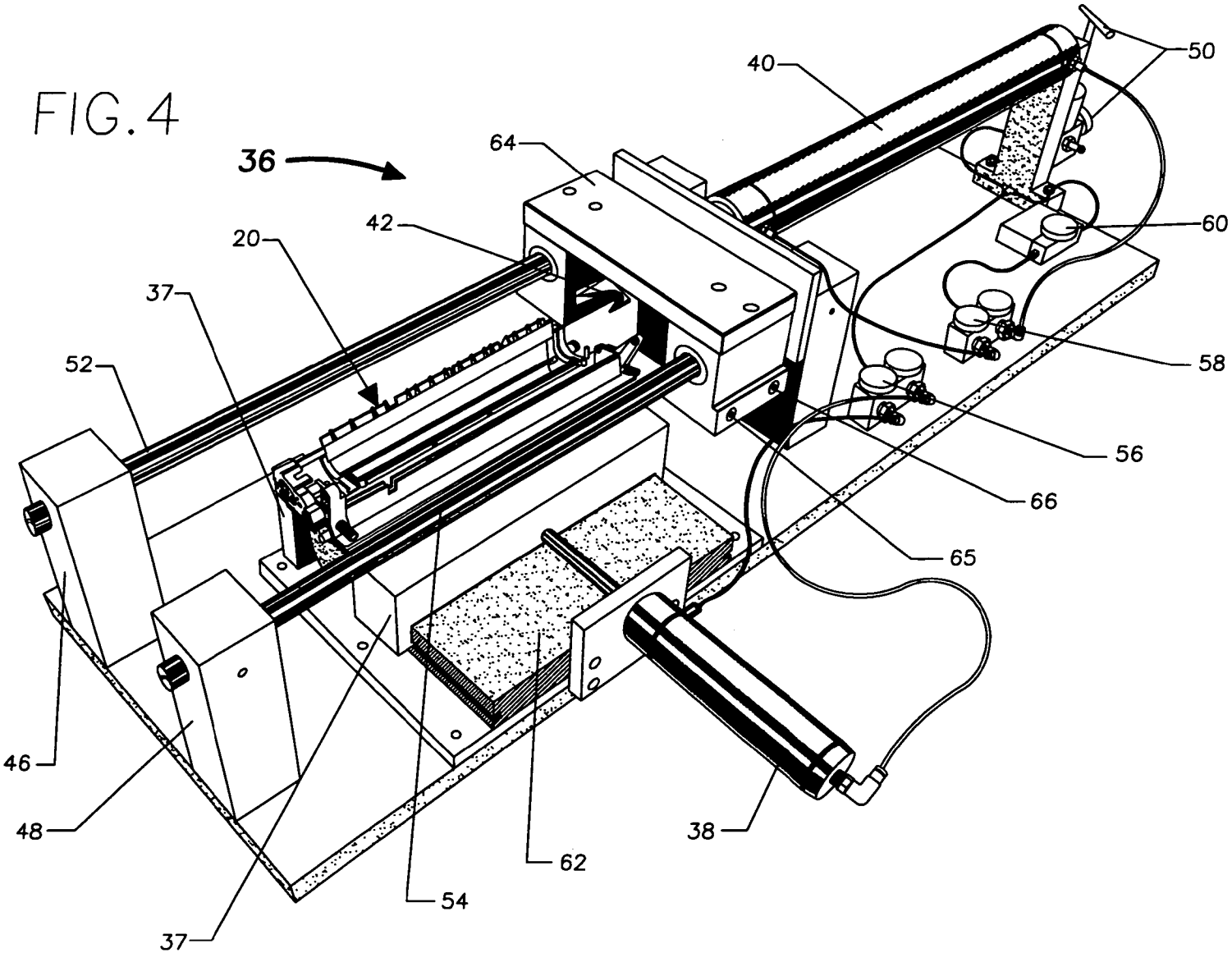
FIG. 4 is a perspective view of a preferred embodiment of the present system used to separate the roller section from the hopper section of a toner cartridge.
Figure 5:
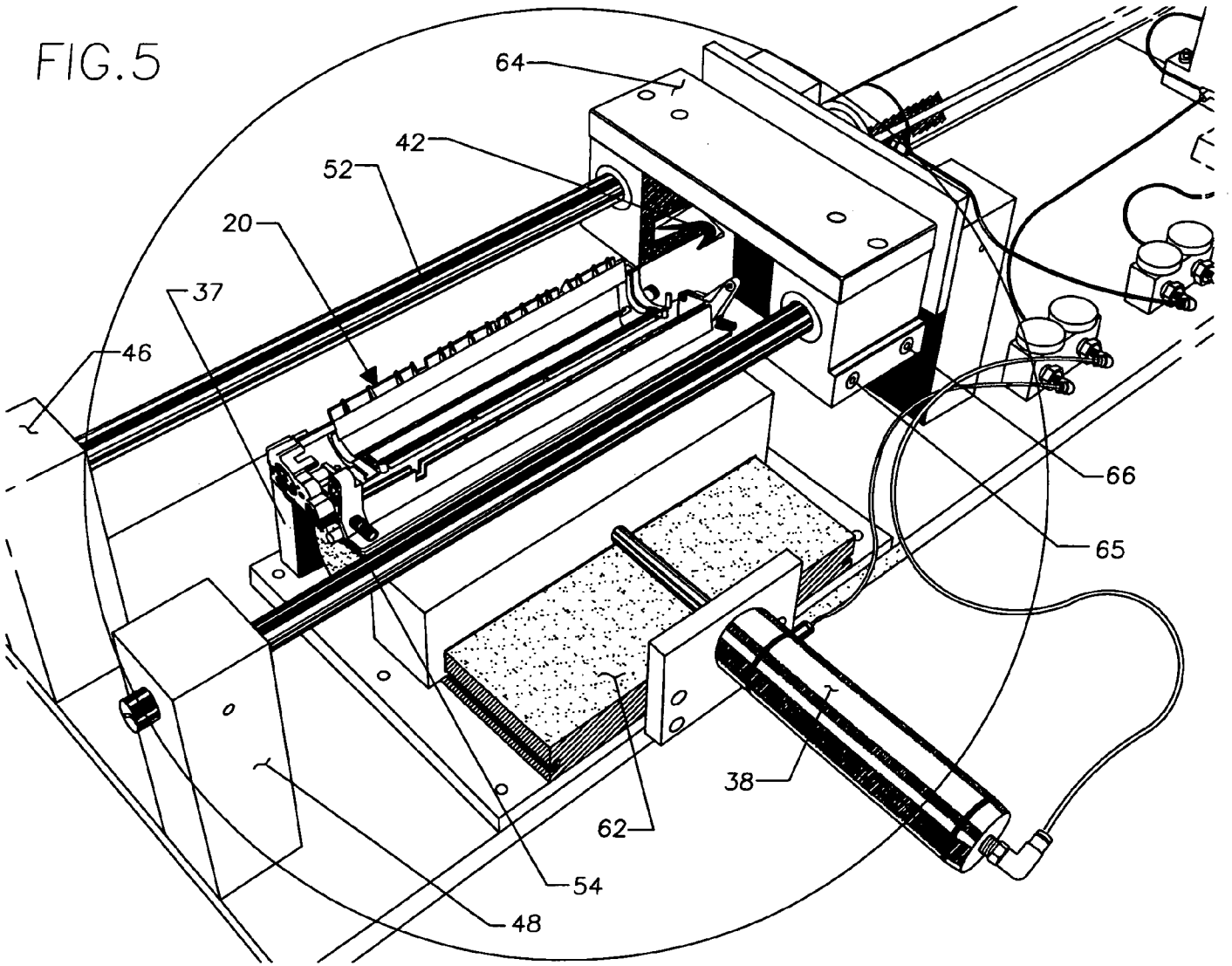
FIG. 5 is an enlarged view of a portion the FIG. 4 embodiment showing the cartridge holding fixture with a cartridge in place.

FIGS. 4 and 5 are perspective views of the most preferred embodiment of the present cartridge splitter system 36, including as major components fixture 37, conventional Bimba brand pneumatic actuating cylinders 38 and 40. Splitting blades 42, 44 (not shown in FIG. 4) are preferably made of grade 01 ground tool steel. Track rail support blocks 46, 48 are preferably of type 6061 aluminum billet construction. Conventional pressure regulator 50 is preferably of a 150 psi regulator, preferably set to a value within the range of 40 psi to 110 psi, most preferably at 00 psi. Splitter track rails 52, 54 guide the blades as they split or separate the toner sections from each other. Conventional Mead Nova brand air actuating switches 56, 58 and 60 are preferably used. As shown in FIGS. 4 and 5, which is an enlarged view of that part of FIG. 4 illustrating the cartridge as it is held in place by the fixture prior to the cutting operation, a used, damaged or depleted toner cartridge 20 is placed in the fixture 37, and then held or locked in place by activating the Bimba brand pneumatic cylinder 38 to slide oil filled cast Nylon block 62 toward the cartridge and lock it into the proper position for precise separation. The steel splitting blades 42 and 44 are held in place by blade housing 64, with their cutting edges facing toward one end of the cartridge 20. The blade housing 64 is positioned on track rails 52 and 54, which in turn are held in place by support blocks 46 and 48. The blade housing has the capability to facilitate rapid change of blades to accommodate differently shaped cartridge walls, as different makes and models of cartridges are repaired. The blade housing 64 is positioned on, typically, a ¾ inch diameter bar stock track rails 52, 543, which in turn are held in place by the type 6061 aluminum billet support blocks 46 and 48. The blade housing 64 is moved along the track rails 52 and 54 by operation of the air switches 56, 58 and 60 to pressurize air actuated Bimba brand cylinder 40. The pressure in cylinder 40 is controlled by the variable pressure regulator 50, most preferably set at about 100 psi. The shape and configuration of the splitting blades 42 and 44 are adapted for each type and shape of toner cartridge, so that their cutting edges precisely cut through the tone cartridge at the joint where its hopper section is welded to its roller section. The blades are held in place by bolts 65 and 66.

As will be appreciated, alternate structures may be used to separate the hopper section from the roller section, so long as the fixture is capable of holding the cartridge in place during the cutting operation, and the structure is capable of precisely separating the toner section from the roller section of the cartridge. The cutting blades must be positioned so that they can be moved relative to the joining seam of the cartridge, and along the joining seam to cleanly separate the two sections from each other. Preferably this is accomplished by having one support structure for holding the cartridge in a fixed position relative to the cutting blades, a second support structure for holding the cutting blades in a fixed position relative to the cartridge, and a track along which the cutting blades are moved through the seam. The preferred motive force for moving the blades along the track is by a pneumatic cylinder; however, other conventional structures and methods could be used to move the cutting blades along the joining seam of the cartridge with sufficient force to cleanly separate the hopper section from the roller section.

The materials of construction of the jig, rails, switches, cylinders can be of any type, so long as they have sufficient strength and are capable of generating sufficient force to accomplish the clean cutting result and do not interfere with accomplishment of the splitting process.

Figure 6:
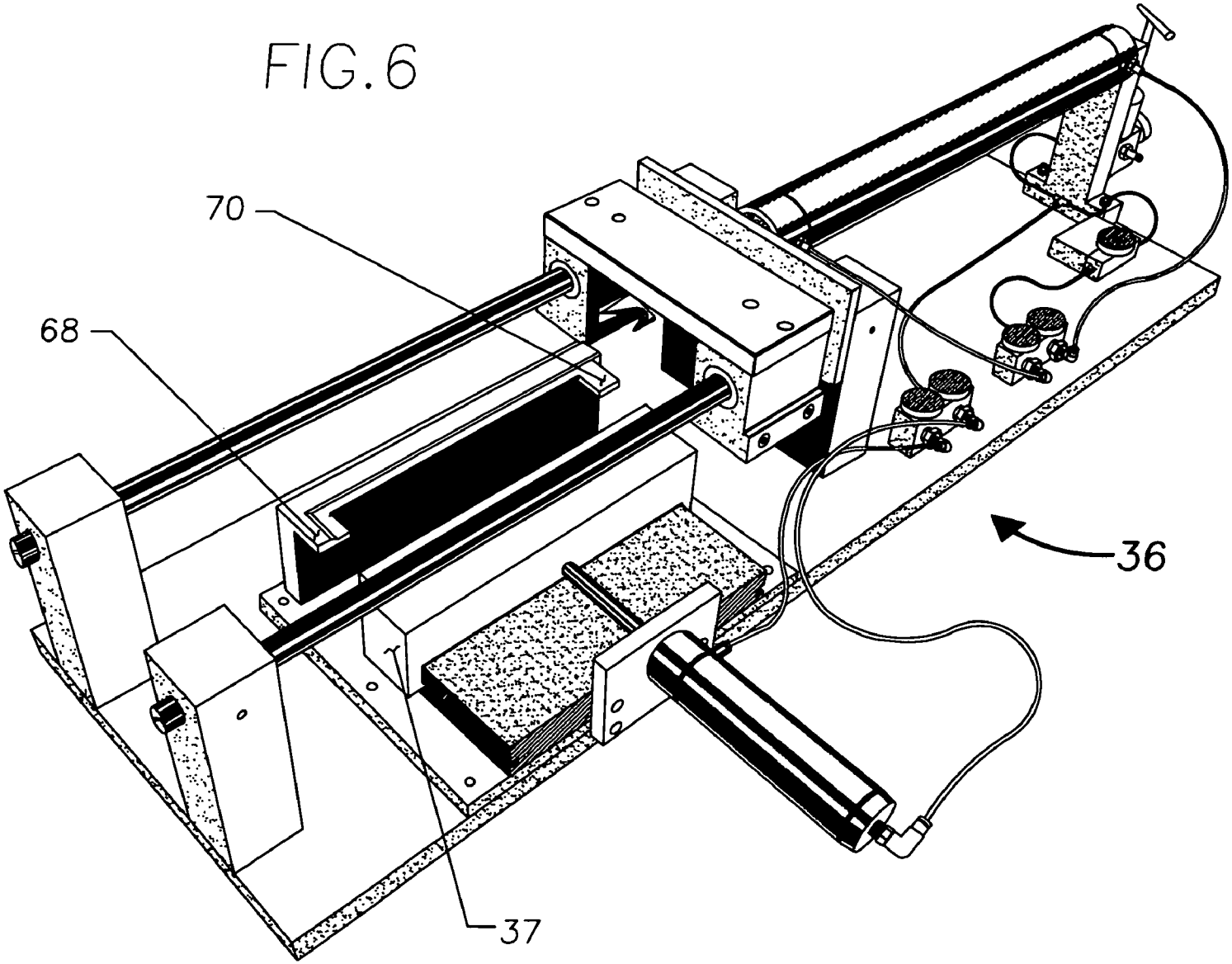
FIG. 6 is the FIG. 5 view without the cartridge in place.
Figure 7:
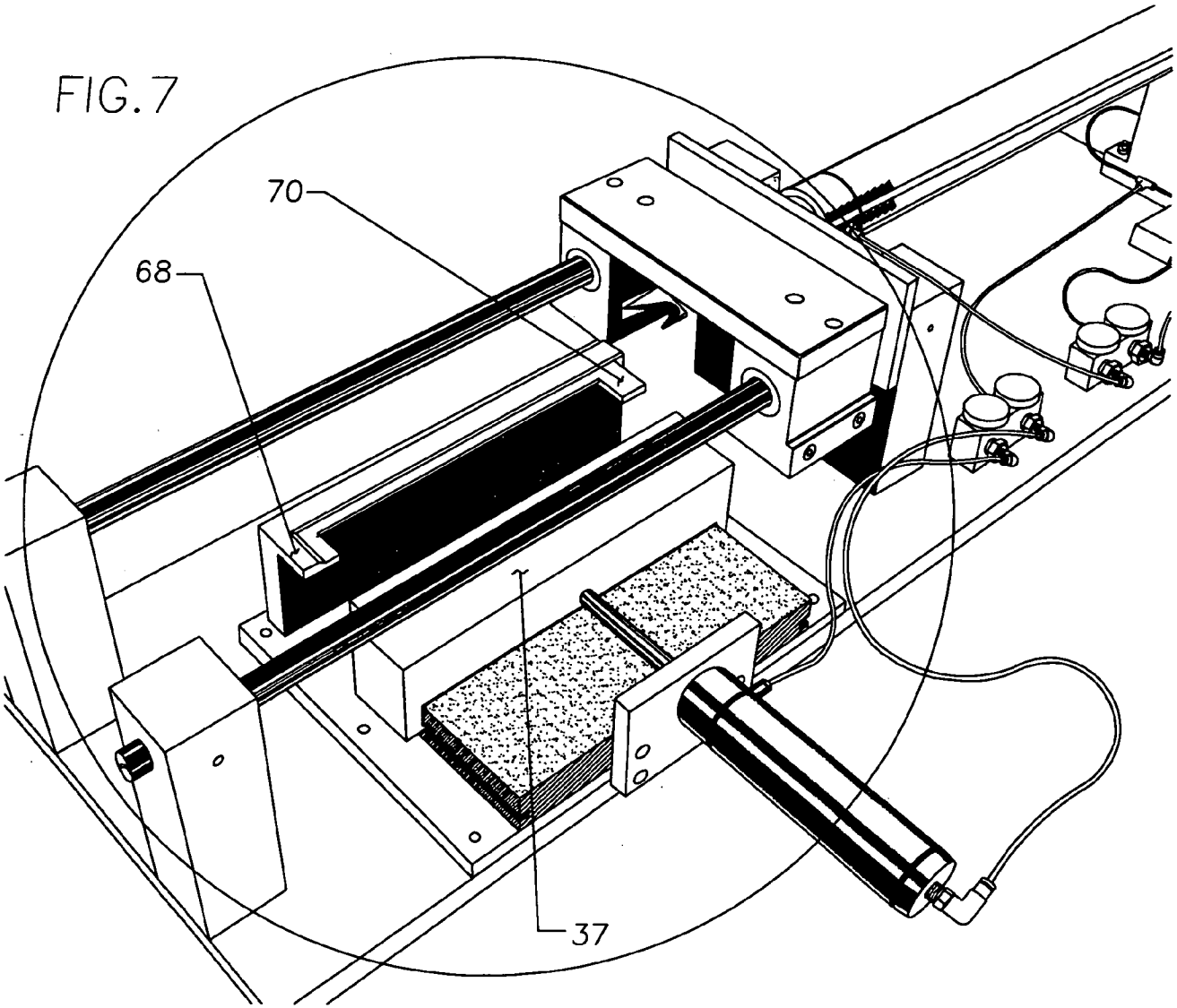
FIG. 7 is an enlarged view of that portion of FIG. 5 showing the cartridge holding fixture.

FIGS. 6 and 7 show the splitting machine 36, but without a cartridge positioned in the fixture 37. The fixture includes tangs 68, 70 that are configured to conform to and extend into molded slots in the cartridge. Once the pneumatic cylinder 38 pushes the sliding block 62 against the cartridge, the cartridge is firmly held in place. The tangs are customized for the particular type of cartridge to be split. As will be appreciated, differently configured tangs will be used for cartridges having different external configurations. Once the hopper and the roller sections have been split, they can be reassembled and reused, provided that the splitting process is accomplished with sufficient precision. As may be seen the present system can be configured to hold, split and reassemble many differently configured cartridge from different manufacturers. The specific configuration of the tangs will vary, and any such configuration is considered to be within the scope of the present invention so long as the tangs function to hold the cartridge in place during the cutting process. The fixture preferably has tangs on one side only as illustrated. The cartridge does not move during the separating operation because the cartridge is of a rectangular shape, and with the tangs inserted into two molded slots in the cartridge, the pressure caused by the splitting process keeps the cartridge in a fixed position so that it does not move in any direction. Thus, the double tangs prevent movement of the cartridge during cutting.

Figure 8:
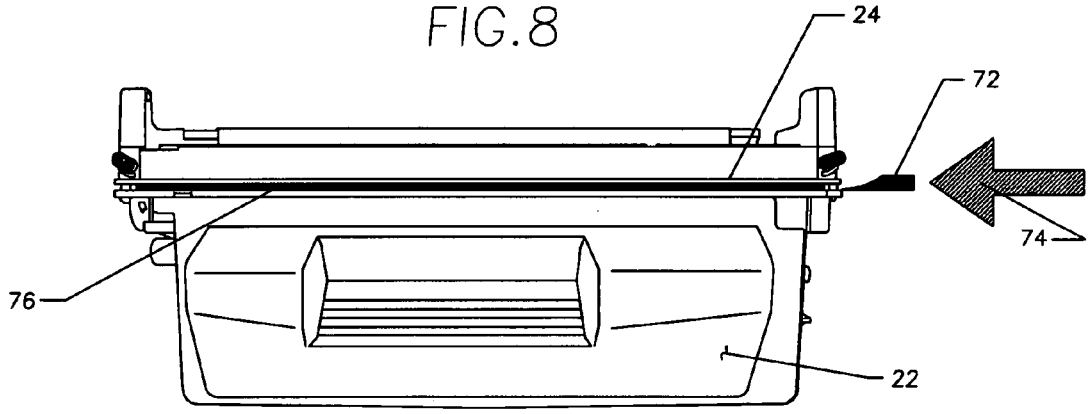
FIG. 8 is a schematic view of a presently preferred process showing the cutter blade symbolically cutting or separating the cartridge as the blade enters the cartridge at one of its ends.
Figure 9:
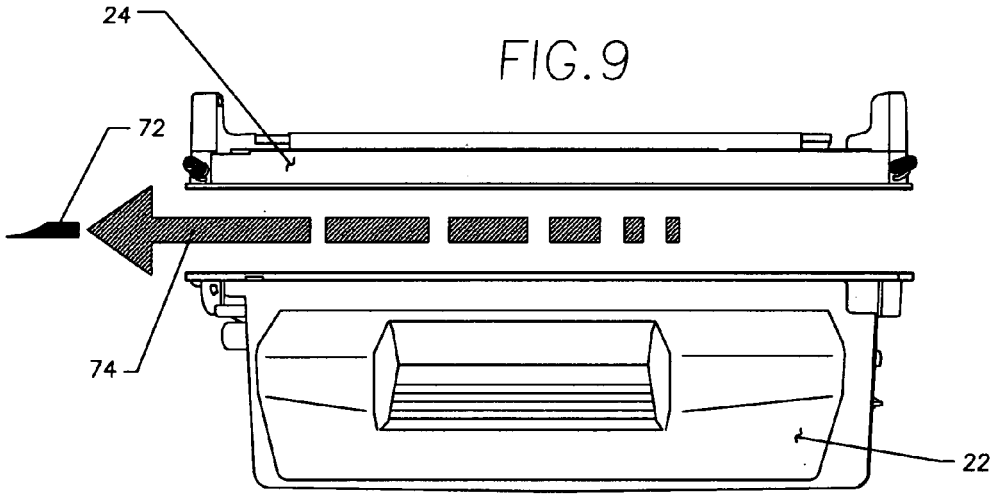
FIG. 9 is a schematic view of the FIG. 8 process as the symbolic cutter blade exits from the toner cartridge at its other end.
Figure 10:
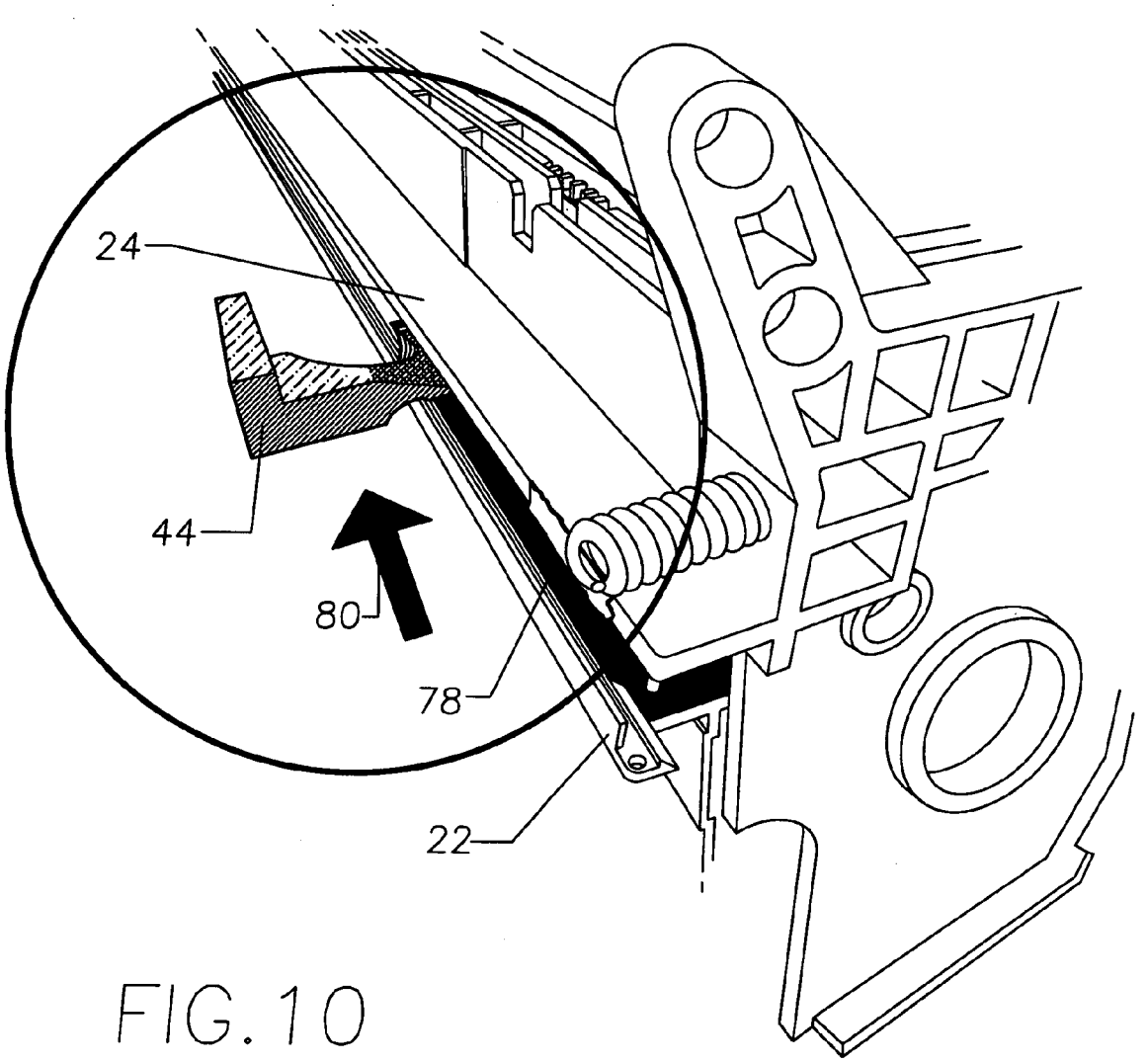
FIG. 10 is a schematic view of the FIG. 4 embodiment as the splitting blade separates the upper, roller section from the lower, toner section of the cartridge.
Figure 11:
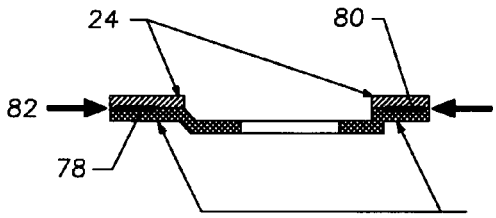
FIG. 11 is a schematic end view of the present system in which two arrows show where the splitting blades separate the roller section from the toner hopper section.
Figure 12:
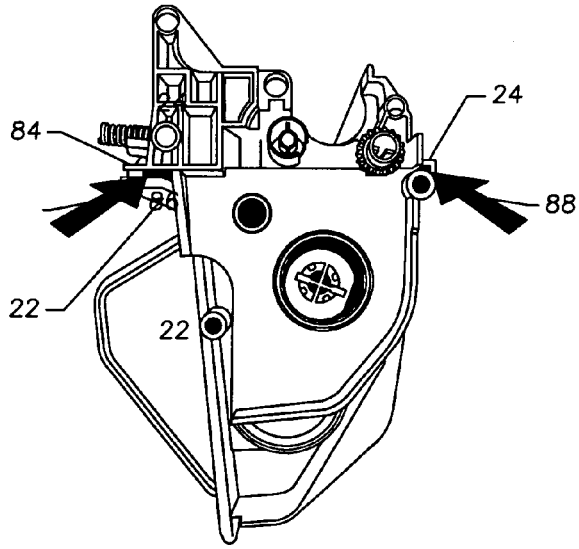
FIG. 12 is an end view of the FIG. 4 embodiment in which two arrows show where the splitting blades separate the roller section from the toner hopper section.

FIGS. 8-12 show the cutting or splitting process both schematically and as related to the FIG. 4 embodiment. FIG. 8 is a front, side schematic view showing a representative cutting blade 72 positioned to begin cutting in the direction of arrow 74. During the splitting or cutting operation, blade 72 and its corresponding blade on the opposite side (not shown in FIG. 8 or 9) are moved along the cartridge flange in the area shown at the dark line 76 to separate the hopper section 22 from the roller section 24. The blade 74 is driven by the force generated by pneumatic cylinder 40 to split the cartridge, as shown in FIG. 9 where the blade 72 has completed its pass through the welded material that previously had joined the hopper section 22 to the roller section 24. FIG. 10 illustrates the cutting process for the FIG. 4 embodiment, and at the time when the blade 44 moves in the direction of arrow 80 and has begun cutting through the seam, or weld material at 78 to separate the hopper 22 from the roller section 24. FIG. 11 is an end, cross-section schematic view showing the location of the cutting along the lines 78, 80 between the flanges of the hopper section 22 and roller section 24 of the cartridge. The blades enter the cartridge at arrows 82, 84. FIG. 12 is an end view of the FIG. 4 embodiment showing the location of the cutting at arrows 86, 88, where the weld material joins the hopper section 22 to the roller section 24. In accordance with the present invention, it is preferred that the splitting takes place only along the joining surfaces of the hopper and roller sections.

Figure 13:
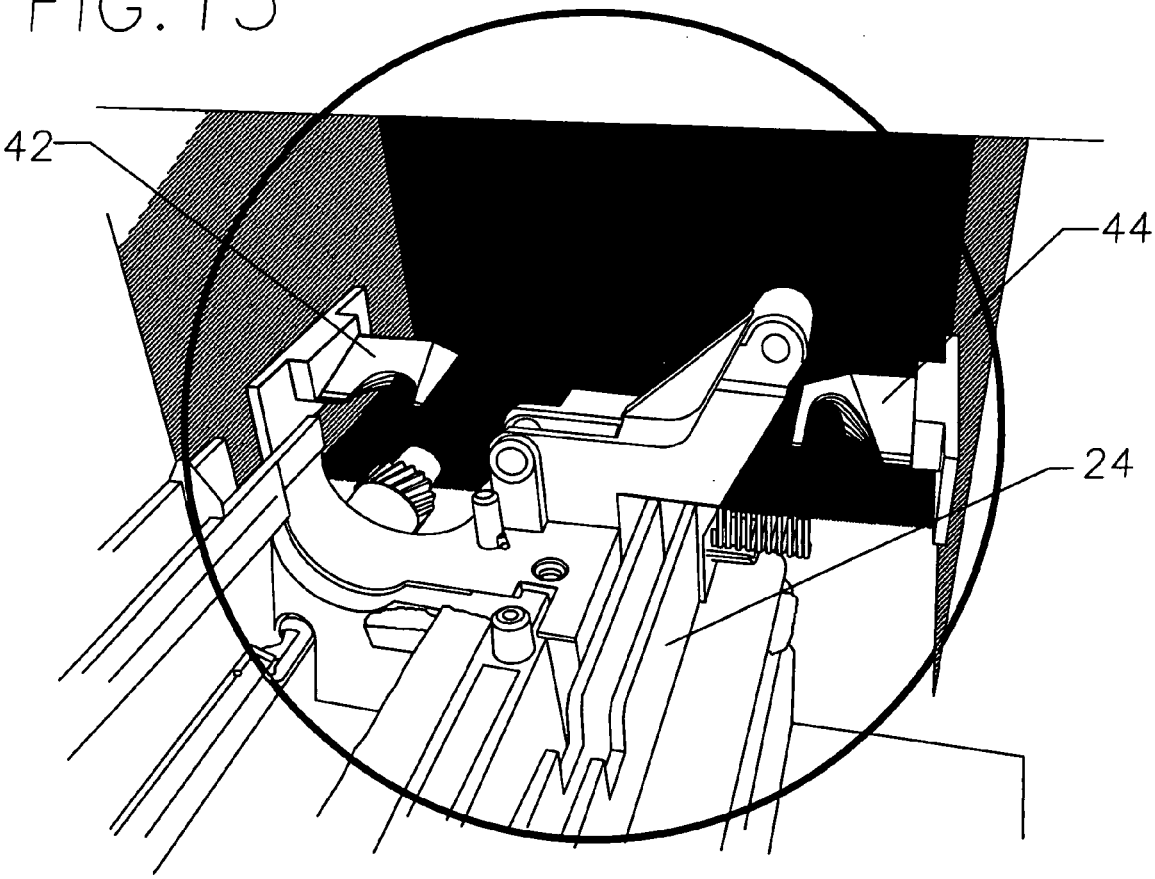
FIG. 13 is a close-up perspective view of the splitter blades of the FIG. 4 embodiment.
Figure 14:
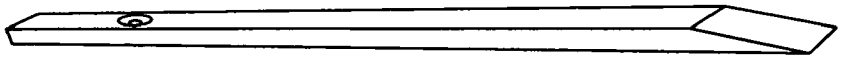
FIG. 14 is a close-up perspective view of an alternate embodiment splitter blade for use in the present system and method.
Figure 15:
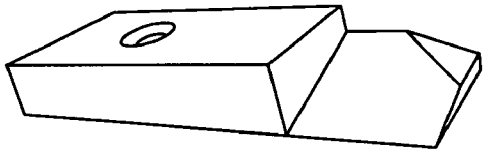
FIG. 15 is a close-up perspective view of an alternate embodiment splitter blade for use in the present system and method.
Figure 16:
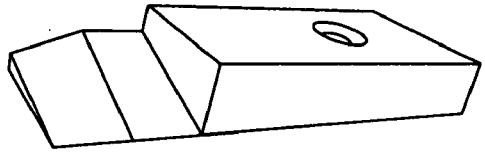
FIG. 16 is a close-up perspective view of an alternate embodiment splitter blade for use in the present system and method.
Figure 17:
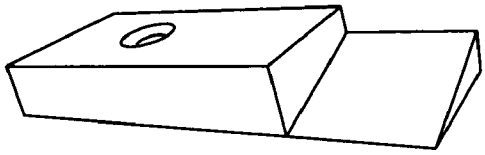
FIG. 17 is a close-up perspective view of an alternate embodiment splitter blade for use in the present system and method.
Figure 18:
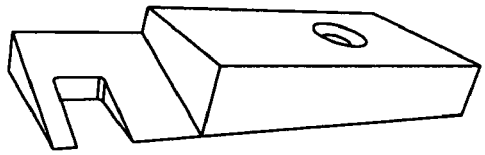
FIG. 18 is a close-up perspective view of an alternate embodiment splitter blade for use in the present system and method.
Figure 19:
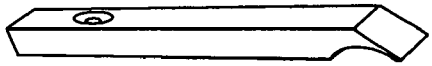
FIG. 19 is a close-up perspective view of an alternate embodiment splitter blade for use in the present system and method.
Figure 20:
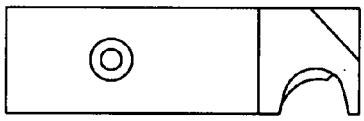
FIG. 20 is a top view of one of the splitter blades of the FIG. 4 embodiment.
Figure 21:
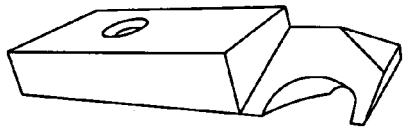
FIG. 21 is a top, side perspective view of the splitter blade shown in FIG. 20.
Figure 22:
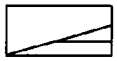
FIG. 22 is a side view of the splitter blade taken from the right side of the FIG. 20 view.
Figure 23:
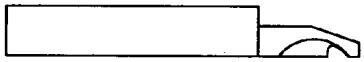
FIG. 23 is a front side view of the splitter blade taken from the bottom of the FIG. 20 view.
Figure 24:
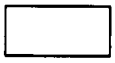
FIG. 24 is a top view of the splitter blade taken from the left side of the FIG. 20 view.
Figure 25:
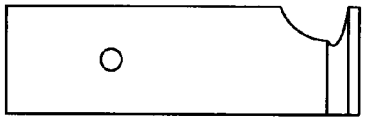
FIG. 25 is a bottom view of the splitter blade taken from under the FIG. 20 view.
Figure 26:
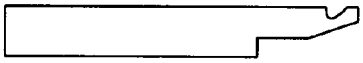
FIG. 26 is a rear view of the splitter blade taken from the top side of the FIG. 20 view.
Figure 27:
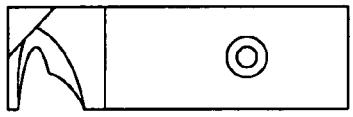
FIG. 27 is a top view of the FIG. 4 embodiment splitter blade on the opposite side of the splitter blade shown FIGS. 20-26.
Figure 28:
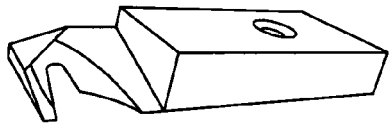
FIG. 28 is a top, side perspective view of the splitter blade shown in FIG. 27.
Figure 29:
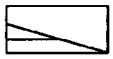
FIG. 29 is a side view of the splitter blade taken from the left side of the FIG. 27 view.
Figure 30:
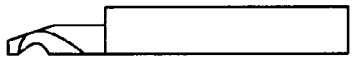
FIG. 30 is a front side view of the splitter blade taken from the bottom of the FIG. 27 view.
Figure 31:
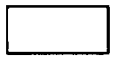
FIG. 31 is a top view of the splitter blade taken from the right side of the FIG. 27 view.
Figure 32:
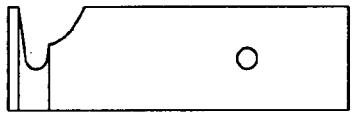
FIG. 32 is a bottom view of the splitter blade taken from under the FIG. 27 view.
Figure 33:
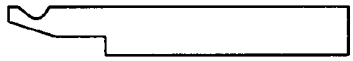
FIG. 33 is a rear view of the splitter blade taken from the top side of the FIG. 27 view.

FIG. 13 is a perspective view of the FIG. 4 embodiment that shows both cutting blades 42 and 44. In this embodiment the two blades have different configurations, which are chosen to facilitate cutting of each side of the welded cartridge, respectively. As may more clearly be seen in the orthographic views of FIGS. 20-26, and 27-33, each of the blades 42 and 44, respectively, has specific shapes that facilitate cutting of the particular weld joint of the type of cartridge for which the FIG. 4 embodiment is optimized.

As may be appreciated, various blade configurations may be used in the present invention. Blade shapes may vary, depending on the complexities and configuration of the cartridge to be split, but the overall function remains the same: cleanly separating the upper magnetic or developer roller section from the toner hopper section. FIGS. 14-19 illustrate alternate embodiments of cutter blade configurations for use in the present system and method.

With reference to the above figures and FIG. 34, the steps of a preferred embodiment of the present method will be described, beginning with a depleted laser cartridge 20 that has been partially disassembled in conventional fashion. This cartridge is then visually inspected for damage and whether it is suitable to be repaired or remanufactured. Each suitable cartridge is then disassembled to remove external components, including the gear housing, end plates, rollers and the toner hopper cap, etc. Then any residual toner is removed and the cartridge is cleaned.

Next the hopper section is separated from the roller section along the plane, or flanges of these sections by splitting the cartridge at the weld that joins the two sections together. Specifically, a toner cartridge that is going to be split is preferably placed by hand into the splitter jig by placing it onto tow tangs that are slipped or inserted into two molded recesses in the cartridge. The splitting machine is plugged into an air supply that has preferably a capability of at least about 110 pounds per square inch (psi) of compressed air. The splitting machine preferably uses 100 psi during operation, although pressures in the range of from 40 psi to about 110 psi will work for the intended purpose of separating the cartridge sections from each other. The air pressure regulator can be set to any desired pressure within that range, and depending on the characteristics of the specific toner cartridge being split. For example, a toner cartridge with a relatively narrow or thin weld would require an air pressure that is less than would be required to split a cartridge having a relatively wide and/or thick weld. In operation, the air pressure is set or adjusted by turning a "Tee" handle on the top of the air pressure regulator. The pressure is read from an air pressure gauge mounted on the regulator, in psi units.

To prepare the cartridge for being held in place during the time the blades cut through the weld, the holding cradle is activated by depressing or activating the pneumatic air switches 60 and then 59, or both switches simultaneously. Switch 60 permits air pressure to travel to the rest of the splitter machine parts. Air cylinder 38 is then activated when the pressure reaches a pre-set value, and moves the cradle 37 toward, and locks the toner cartridge into place by applying pressure against the side of the cartridge. Next the pneumatic switch 58 is depressed, with switch 60 being depressed as well, to activate air cylinder 40. Cylinder 40, when activated, pushes the splitter blade housing 64 along the splitter track rails 52 and 54 toward the end of the toner cartridge. The splitter blades are inside of the splitter blade housing. The blades have a specific design or angles of curvature optimized for each different type or configuration of toner cartridge that is to be separated at the weld. The splitter blade housing passes over the toner cartridge and the blades, held in place by bolts 65, 66, cut, split and separate the roller section from the hopper section of the toner cartridge.

Once the splitter housing has reached the end of the rails, the cartridge is split, the pneumatic switches are depressed again, to activate the air cylinder 40 and return the housing to its original position. Once the cradle has moved back to its original position, then the two sections of the cartridge are preferably removed by hand and made available for inspection and further processing.

The separated components are inspected for cleanliness, integrity. Those components that pass inspection are then re-used, with the other components either discarded or re-cleaned as appropriate.

Figure 34:
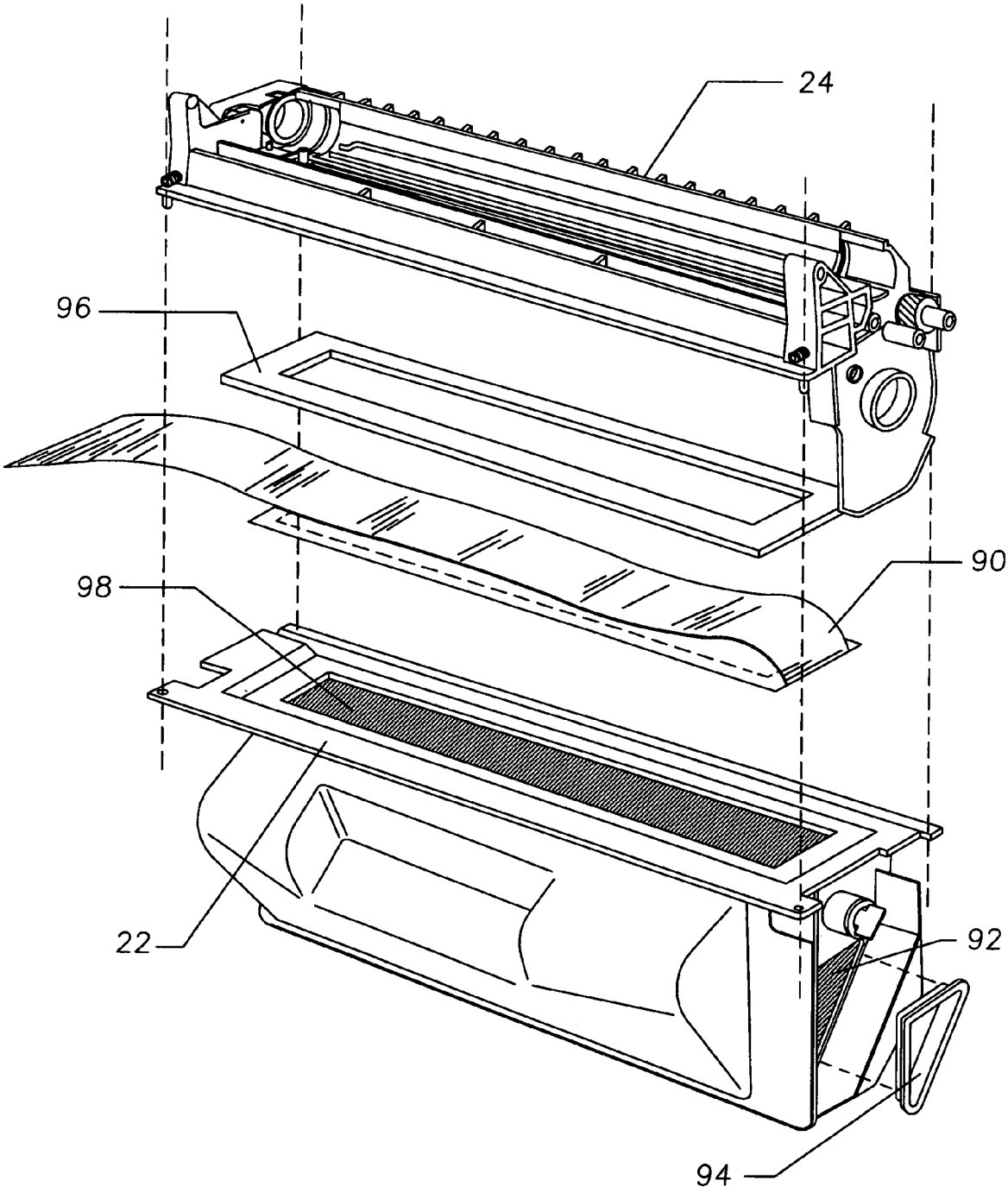
FIG. 34 is an exploded view of components of a toner cartridge repaired and/or reassembled using the present system and method.

Once the toner hopper tank has been cleaned and is free of any residual toner, it is ready for application of a hopper seal strip 90, as shown in FIG. 34. It is important that the area where adhesive from the seal strip 90 is to be applied to the hopper, area 40, is free from any residual toner. Next the toner hopper is filled with appropriate toner at the fill hole 92. Then toner fill cap 94 is installed, and the hopper tank is tested for leaks, thus also testing the integrity of the adhesive integrity of the seal strip 90.

Next the roller section 24 is mated with the recharged toner hopper section 22 to form a loose assembly. This loose assembly is placed into welding jig that is configured to precisely align the components of the particular cartridge model being repaired or remanufactured. Next the clamp on the jig is operated to secure the hopper and roller sections in proper alignment, each to the other. Next, an ultrasonic welding horn is lowered to the assembly, actuated and welds the two sections together. The welded cartridge is then removed from the welding jig.

As shown in FIG. 34, the hopper section 22 and roller section 24 has been split along the seam or weld. Also shown at 98 is an open area of the toner hopper tank from which toner is transferred to the other components during operation of the cartridge to print. Open foam seal 96 is positioned around the periphery of the open area 98, and functions to seal the cartridge and to prevent escape or leakage of toner from the cartridge once assembled. Toner hopper seal 90 is also shown positioned over the area 98. After the toner hopper seal 90 is pulled out to ready the cartridge for operation, the open cell foam cell prevents toner from seeping out through the slot from which the toner hopper seal was pulled.

Then the remaining components, such as roller, photoconductive drum, new or reconditioned blades, etc. are installed in the roller section. Finally, the waste hopper (not shown) is installed, and the reassembled toner cartridge is subjected to quality control testing, after which the acceptable cartridges are packaged for shipment.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method of repairing a spent toner cartridge, comprising:

providing a toner cartridge having a hopper section and having a roller section joined together at a joining seam;

providing cutting blades adapted to cut though the cartridge at the joining seam;

securely fastening the toner cartridge in a predetermined position relative to the cutting blades;

moving the cutting blades to provide a first separated hopper section and a first separated roller section:

a. along the a path formed by the joining seam;

b. without removal of material located at the joining seam; and, c. with force sufficient to separate the hopper section from the roller section to form the first separated hopper section and the first separated roller section; and, joining the first separated hopper section to the separated roller section.

2. The method of claim 1 wherein the first separated hopper section is joined to the first separated roller section by welding.

3. The method of claim 1 wherein joining the first separated hopper section to the separated roller section is by ultrasonic welding.

4. The method of claim 1 wherein the step of securely fastening the toner cartridge in a predetermined position relative to the cutting blades includes pressurizing a pneumatic cylinder.

5. The method of claim 1 wherein the step of moving the cutting blades with force sufficient to separate the hopper section from the roller section to form the first separated hopper section and the first separated roller section includes pressurizing a pneumatic cylinder.

6. A system for making a re-assembled toner cartridge from a spent toner cartridge having a hopper section joined to a roller section at a seam, comprising:

a base adapted to hold a fixture, rail supports, rails, a blade housing, a first pneumatic cylinder and a second pneumatic cylinder;

the fixture positioned on the base, having a movable block portion and adapted to hold a toner cartridge in a predetermined position;

the rail supports positioned on the base and adapted to support first ends of the two rails;

the blade housing positioned on the base, adapted to support second ends of the two rails and adapted to support two blades aligned with the predetermined position so that upon movement of the blades along the path the blades will pass though the seam joining the hopper section to the roller section;

the two blades securely fastened to the blade housing, adapted to separate the hopper section from the roller section along the seam;

the rails extending in parallel relation along a path from the blade housing to the rail supports;

the first pneumatic cylinder adapted to move the movable block portion of the fixture from a first position to the predetermined position; and, the second pneumatic cylinder adapted to move the blade housing and the two blades along the path with force sufficient to separate the hopper section from the roller section.

7. A method of separating a toner cartridge, comprising:

providing a laser printer toner cartridge having a hopper section and having a roller section joined together at a joining weld seam;

providing cutting blades adapted to cut though the cartridge at the joining weld seam;

securely fastening the toner cartridge in a predetermined position relative to the cutting blades;

moving the cutting blades to provide a first separated hopper section and a first separated roller section:

a. along the a path formed by the joining weld seam;

b. without removal of cartridge material located at the joining weld seam; and, c. with force sufficient to separate the hopper section from the roller section to form the first separated hopper section and the first separated roller section.

8. The method of claim 7 wherein moving the cutting blades is by application of pneumatic pressure.

9. The method of claim 7 wherein the joining weld seam contains original weld material and at least some of the original weld material in the joining weld seam remains welded to the first separated hopper section and/or to the first separated roller section.

10. The method of claim 9 wherein substantially all of the original weld material remains welded to the first separated hopper section and/or to the first separated roller section.

* * * * *